US007967950B2

(12) United States Patent
Horenziak et al.

(10) Patent No.: US 7,967,950 B2
(45) Date of Patent: Jun. 28, 2011

(54) HIGH BULK STRONG ABSORBENT SINGLE-PLY TISSUE-TOWEL PAPER PRODUCT

(75) Inventors: Steven Anthony Horenziak, Fairfield, OH (US); Ellyne Elizabeth Prodoehl, West Chester, OH (US); Nicholas Jerome Wilke, II, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 285 days.

(21) Appl. No.: 12/043,589

(22) Filed: Mar. 6, 2008

(65) Prior Publication Data

US 2008/0149286 A1 Jun. 26, 2008

(51) Int. Cl.
*D21H 27/30* (2006.01)
*B31F 1/07* (2006.01)

(52) U.S. Cl. ..... 162/117; 162/109; 428/174; 428/220

(58) Field of Classification Search ..... 162/109–117, 162/361, 362; 428/152–154, 156, 174, 179, 428/220; 156/209; 264/119, 284
See application file for complete search history.

(56) References Cited

U.S. PATENT DOCUMENTS

| | | | | |
|---|---|---|---|---|
| 5,294,475 | A * | 3/1994 | McNeil | 428/154 |
| 5,686,168 | A * | 11/1997 | Laurent et al. | 428/179 |
| 6,511,579 | B1 * | 1/2003 | Edwards et al. | 162/111 |
| 6,602,577 | B1 * | 8/2003 | Ostendorf et al. | 428/156 |
| 6,802,937 | B2 * | 10/2004 | Johnston et al. | 162/117 |
| 7,374,638 | B2 * | 5/2008 | Horenziak et al. | 162/117 |
| 7,531,062 | B2 * | 5/2009 | Kershaw et al. | 162/113 |
| 2005/0067126 | A1 | 3/2005 | Horenziak et al. | |
| 2005/0178513 | A1 | 8/2005 | Russell et al. | |
| 2006/0280910 | A1 | 12/2006 | Boatman et al. | |

FOREIGN PATENT DOCUMENTS

| | | |
|---|---|---|
| GB | 1 245 280 | 9/1971 |
| WO | WO 2005/032320 A | 4/2005 |
| WO | WO 2006/132883 A | 12/2006 |

* cited by examiner

*Primary Examiner* — Eric Hug
(74) *Attorney, Agent, or Firm* — Roddy M. Bullock; Betty J. Zea

(57) ABSTRACT

The present invention relates to absorbent tissue-towel paper products comprising one essentially continuous ply of fibrous structure having a first surface and a second surface, wherein the product has an HFS absorbency greater than 8 g/g and the first surface exhibits an embossment height of at least 650 μm and the second surface exhibits an embossment height of at least about 650 μm.

5 Claims, 1 Drawing Sheet

HIGH BULK STRONG ABSORBENT SINGLE-PLY TISSUE-TOWEL PAPER PRODUCT

CROSS REFERENCE TO RELATED APPLICATIONS

This application claims the benefit of U.S. patent application Ser. No. 10/952,119, filed Sep. 28, 2004, now U.S. Pat. No. 7,374,638, and U.S. Provisional Application No. 60/507,021, filed Sep. 29, 2003, both of which are incorporated herein by reference.

FIELD OF THE INVENTION

This invention relates to high absorbency single-ply tissue-towel paper products which are deep nested embossed without tearing. The single-ply tissue-towel paper products include products such as towels, napkins, toilet tissue, facial tissue, and wipes.

BACKGROUND OF THE INVENTION

The embossing of paper products to make those products more absorbent, softer and bulkier is well known in the art. Embossing technology has included pin-to-pin embossing where protrusions on the respective embossing rolls are matched such that the tops of the protrusion contact each other through the paper product, thereby compressing the fibrous structure of the product. The technology has also included male-female embossing, or nested embossing, where protrusions of one or both rolls are aligned with either a non-protrusion area or a female recession in the other roll. U.S. Pat. No. 4,921,034, issued to Burgess et al. on May 1, 1990 provides additional background on embossing technologies.

Deep nested embossing of multiply tissue products is taught in U.S. Pat. Nos. 5,686,168 issued to Laurent et al. on Nov. 11, 1997; and 5,294,475 issued to McNeil on Mar. 15, 1994. While these technologies have been useful in improving the embossing efficiency and glue bonding of these multiply tissues, manufacturers have had difficulty using such deep nested embossing processes in low density single ply products because the strain exerted by the embossing process tends to tear the fibrous structure of the tissue product. Such tearing dramatically reduces the strength and integrity of the tissue product.

It has been found that certain selected fibrous structures may be deep nested embossed without significant tearing resulting in an essentially continuous tissue ply.

SUMMARY OF THE INVENTION

An absorbent tissue-towel paper product comprising one essentially continuous ply of fibrous structure having a first surface and a second surface, wherein the product has a HFS absorbency greater than 8 g/g and both the first surface and the second surface exhibit an embossment height of at least about 650 μm.

DETAILED DESCRIPTION OF THE INVENTION

Figure 1:
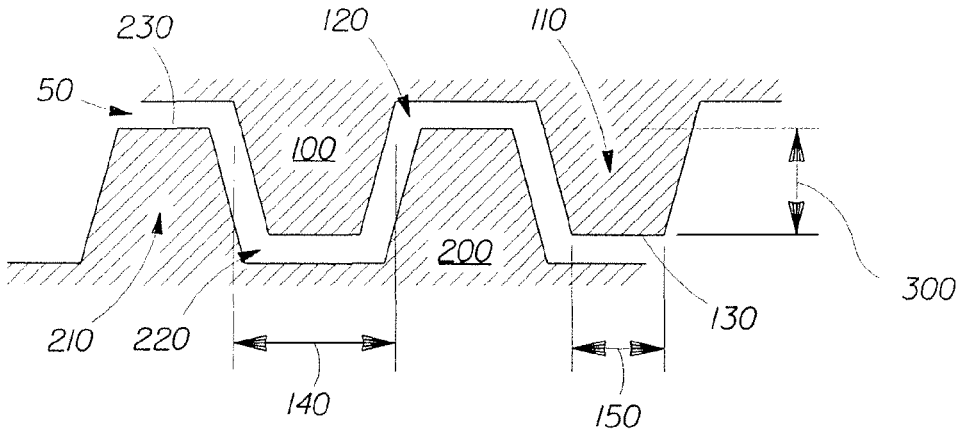
FIG. 1 is a side view of the gap between two engaged emboss rolls of a deep nested embossing process.

The present invention relates to absorbent tissue-towel paper products comprising one essentially continuous ply of fibrous structure having a first surface and a second surface, wherein the product has an HFS absorbency greater than 8 g/g and both the first surface and the second surface exhibit an embossment height of at least about 650 μm.

The term "absorbent" and "absorbency" means the characteristic of the ply of the fibrous structure which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured here in by the Horizontal Full Sheet (HFS) test method described in the Test Methods section herein.

The term "machine direction" is a term of art used to define the dimension on the processed web of material parallel to the direction of travel that the web takes through the papermaking, printing, and embossing machines.

Similarly, the term "cross direction" or "cross-machine direction" refers to the dimension on the web perpendicular to the direction of travel through the papermaking, printing, and embossing machines.

As used herein, the phrase "tissue-towel paper" refers to products comprising paper tissue or paper towel technology in general, including but not limited to conventionally felt-pressed or conventional wet pressed tissue paper; pattern densified tissue paper; and high-bulk, uncompacted tissue paper. Non-limiting examples of tissue-towel products include toweling, facial tissue, bath tissue, and table napkins and the like.

The phrase "essentially continuous" defines the physical integrity of the tissue ply as being essentially without tears in the fibrous structure. The most preferred embodiment of the present invention and the intent of the invention is to obtain embossed tissue products without tearing of the structure. However, the nature of low density, absorbent paper technology may result in a low level of tear imperfections. Therefore, as used herein the phrase "essentially continuous" means that the tissue-towel fibrous structure has fewer than 5 tear imperfections per square foot of the tissue from the embossing process, preferably the structure has fewer than 3 tear imperfections per square foot, most preferably the structure has fewer than 1 tear imperfection per square foot. The term "tear" herein means an area of the wet-formed fibrous structure which has been disrupted or punctured in the embossing process sufficiently to create a discontinuity in fiber structure where relatively few fibers remain connected across the discontinuity.

The term "ply" as used herein means an individual sheet of fibrous structure having the use as a tissue product. As used herein, the ply may comprise one or more wet-laid layers. When more than one wet-laid layer is used, it is not necessary that they are made from the same fibrous structure. Further, the layers may or may not be homogeneous within the layer. The actual make up of the tissue paper ply is determined by the desired benefits of the final tissue paper product.

The term "fibrous structure" as used herein mean an arrangement or fibers produced in any typical papermaking machine known in the art to create the ply of tissue-towel paper. "Fiber" as used herein means an elongated particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 disclose layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

The tissue-towel paper product substrate preferred embodiment may comprise any tissue paper product known in the industry. These embodiments may be made according U.S. Pat. Nos. 4,191,609 issued Mar. 4, 1980 to Trokhan; 4,300,981 issued to Carstens on Nov. 17, 1981; 4,191,609 issued to Trokhan on Mar. 4, 1980; 4,514,345 issued to Johnson et al. on Apr. 30, 1985; 4,528,239 issued to Trokhan on Jul. 9, 1985; 4,529,480 issued to Trokhan on Jul. 16, 1985; 4,637,859 issued to Trokhan on Jan. 20, 1987; 5,245,025 issued to Trokhan et al. on Sep. 14, 1993; 5,275,700 issued to Trokhan on Jan. 4, 1994; 5,328,565 issued to Rasch et al. on Jul. 12, 1994; 5,334,289 issued to Trokhan et al. on Aug. 2, 1994; 5,364,504 issued to Smurkowski et al. on Nov. 15, 1995; 5,527,428 issued to Trokhan et al. on Jun. 18, 1996; 5,556,509 issued to Trokhan et al. on Sep. 17, 1996; 5,628,876 issued to Ayers et al. on May 13, 1997; 5,629,052 issued to Trokhan et al. on May 13, 1997; 5,637,194 issued to Ampulski et al. on Jun. 10, 1997; 5,411,636 issued to Hermans et al. on May 2, 1995; EP 677612 published in the name of Wendt et al. on Oct. 18, 1995.

The preferred tissue-towel substrate may be through-air-dried or conventionally dried. Optionally, it may be foreshortened by creping or by wet microcontraction. Creping and/or wet microcontraction are disclosed in commonly assigned U.S. Pat. Nos. 6,048,938 issued to Neal et al. on Apr. 11, 2000; 5,942,085 issued to Neal et al. on Aug. 24, 1999; 5,865,950 issued to Vinson et al. on Feb. 2, 1999; 4,440,597 issued to Wells et al. on Apr. 3, 1984; 4,191,756 issued to Sawdai on May 4, 1980; and U.S. Ser. No. 09/042,936 filed Mar. 17, 1998.

Conventionally pressed tissue paper and methods for making such paper are known in the art. See commonly assigned U.S. patent application Ser. No. 09/997,950 filed Nov. 30, 2001. One preferred tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976, U.S. Pat. No. 4,191,609, issued to on Mar. 4, 1980, and U.S. Pat. No. 4,637,859, issued to on Jan. 20, 1987; U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980.

The softening composition of the present invention can also be applied to uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 published Aug. 12, 1997.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993, the disclosure of which is incorporated herein by reference.

If permanent wet strength is desired, cationic wet strength resins can be added to the papermaking furnish or to the embryonic web. Suitable types of such resins are described in U.S. Pat. Nos. 3,700,623, issued on Oct. 24, 1972, and 3,772,076, issued on Nov. 13, 1973, both to Keim.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

While the preferred embodiment of the present invention discloses a certain softening agent composition deposited on the tissue web surface, the invention also expressly includes variations in which the chemical softening agents are added as a part of the papermaking process. For example, chemical softening agents may be included by wet end addition. In addition, other chemical softening agents, in a form not within the scope of the present invention may be used. Preferred chemical softening agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow)dimethyl ammonium chloride, etc.). Particularly preferred variants of these softening agents include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate.

Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Another class of preferred substrate for use in the process of the present invention is non-woven webs comprising synthetic fibers. Examples of such substrates include but are not limited to textiles (e.g.; woven and non woven fabrics and the like), other non-woven substrates, and paperlike products comprising synthetic or multicomponent fibers. Representative examples of other preferred substrates can be found in U.S. Pat. No. 4,629,643 issued to Curro et al. on Dec. 16, 1986; U.S. Pat. No. 4,609,518 issued to Curro et al. on Sep. 2, 1986; European Patent Application EP A 112 654 filed in the name of Haq; copending U.S. patent application Ser. No. 10/360,038 filed on Feb. 6, 2003 in the name of Trokhan et al.; copending U.S. patent application Ser. No. 10/360,021 filed on Feb. 6, 2003 in the name of Trokhan et al.; copending U.S. patent application Ser. No. 10/192,372 filed in the name of Zink et al. on Jul. 10, 2002; and copending U.S. patent application Ser. No. 09/089,356 filed in the name of Curro et al. on Dec. 20, 2000.

The absorbent tissue-towel paper product of the present invention comprises one essentially continuous ply of fibrous structure having a first surface and a second surface. The tissue-towel paper product has an HFS absorbency greater than about 8 g/g, preferably greater than about 10 g/g, and most preferably greater than about 12 g/g.

All of the embodiments of the present invention are embossed by any deep nested embossed technology known in the industry. The one-ply fibrous structure is embossed in a deep nested embossing process represented in FIG. 1. The structure is embossed in the gap 50 between two embossing rolls, 100 and 200. The embossing rolls may be made from any material known for making such rolls, including without limitation steel, rubber, elastomeric materials, and combinations thereof. Each embossing roll 100 and 200 have a combination of emboss knobs 110 and 210 and gaps 120 and 220. Each emboss knob has a knob base 140 and a knob face 150. The surface pattern of the rolls, that is the design of the various knobs and gaps, may be any design desired for the product, however for the deep nested process the roll designs must be matched such that the knob face of one roll 130 extends into the gap of the other roll beyond the knob face of the other roll 230 creating a depth of engagement 300. The depth of engagement is the distance between the nested knob faces 130 and 230. The depth of the engagement 300 used in producing the paper products of the present invention can range from about 0.04 inch to about 0.08 inch, and preferably from about 0.05 inch to about 0.07 inch such that an embossed height of at least 650 μm, preferably at least 1000μ, and most preferably at least 1250 μm is formed in both surfaces of the fibrous structure of the one-ply tissue-towel product.

Figure 2:
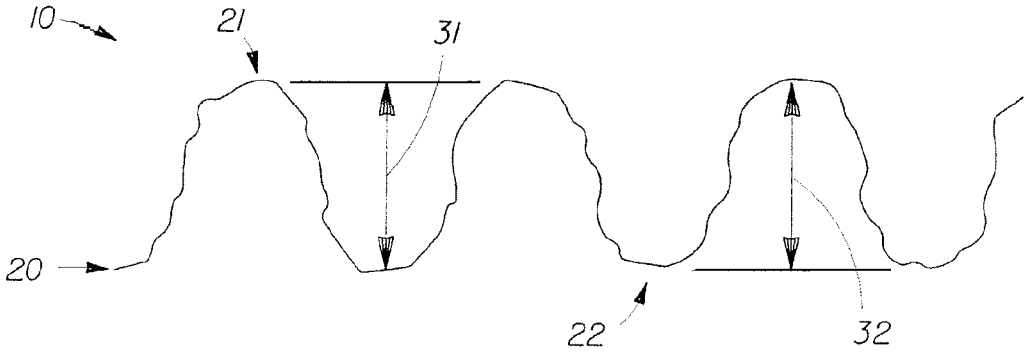
FIG. 2 is a side view of an embodiment of the embossed one ply tissue-towel paper product of the present invention.

Referring to FIG. 2 the tissue-towel product 10 comprises a fibrous structure 20 which is embossed in a deep nested embossing process such that the first surface 21 exhibits an embossment height 31 of at least about 650 μm, preferably at least 1000 μm, and most preferably at least about 1250 μm and the second surface 22 exhibits an embossment height 32 of at least about 650 μm, preferably at least 1000 μm, and most preferably at least 1250 μm. The embossment height, 31 and 32, of the respective surfaces, 21 and 22, of the tissue-towel paper product is measured by the Embossment Height Test using a GFM Primos Optical Profiler as described in the Test Methods herein.

Preferred tissue-towel paper products of the present invention have a Cross Machine direction stretch, "CD Stretch" value before embossing of greater than about 8%, preferably greater than about 10%, and most preferably greater than about 12%. The CD Stretch of the paper product herein is determined on unembossed base product by the % Elongation test described herein in the Test Method section. Preferred absorbent fibrous structures having such a desired higher stretch values which will survive the deep nested embossing process may be achieved in a variety of ways.

One of the benefits of the present invention is that the claimed products are high bulk products compared to itself before embossing. That is, the caliper of the finished product is much greater than the caliper of the product before embossing. The caliper of the finished product is greater than about 150%, preferably greater than about 175%, and most preferably greater than about 200% than the caliper of the base, unembossed product. This increase in caliper is achieved in the present invention without significant tearing of the original one-ply product.

Since the embossing process used to produce the paper products of the present invention is done without significant tearing, much of the strength of the fibrous structure of the one-ply product is maintained through the embossing process. The fibrous structures of the present invention result in a high strength efficiency through the embossing process. The wet burst strength efficiency is the wet burst strength of the paper product, as measured in the Wet Burst Strength Test described in the Test Methods section herein, after embossing divided by the wet burst strength of the base, unembossed paper product, multiplied by 100%. The strength efficiency of the absorbent one-ply tissue-towel product of the present invention are greater than about 60%, preferably greater than about 70% and more preferably greater than about 75%.

EMBODIMENTS

Embodiment 1

One fibrous structure useful in achieving a strong, high CD stretch fibrous structure is the through-air dried (TAD), differential density structure described in U.S. Pat. No. 4,528,239. Such a structure may be formed by the following process.

A pilot scale Fourdrinier, through-air-dried papermaking machine is used in the practice of this invention. A slurry of papermaking fibers is pumped to the headbox at a consistency of about 0.15%. The slurry consists of about 60% Northern Softwood Kraft fibers, refined to a Canadian standard freeness of about 500 ml, and about 40% unrefined Southern Softwood Kraft fibers. The fiber slurry contains a cationic polyamine-epichlorohydrin wet strength resin at a concentration of about 25 lb. per ton of dry fiber, and carboxymethyl cellulose at a concentration of about 6.5 lb. per ton of dry fiber.

Dewatering occurs through the Fourdrinier wire and is assisted by vacuum boxes. The wire is of a configuration having 84 machine direction and 78 cross direction filaments per inch, such as that available from Albany International known at 84×78-M.

The embryonic wet web is transferred from the Fourdrinier wire at a fiber consistency of about 22% at the point of transfer, to a TAD carrier fabric. The wire speed is about 6% faster than the carrier fabric so that wet shortening of the web occurs at the transfer point. The sheet side of the carrier fabric consists of a continuous, patterned network of photopolymer resin, said pattern containing about 330 deflection conduits per inch. The deflection conduits are arranged in a bi-axially staggered configuration, and the polymer network covers about 25% of the surface area of the carrier fabric. The polymer resin is supported by and attached to a woven support member consisting of 70 machine direction and 35 cross direction filaments per inch. The photopolymer network rises about 0.008" above the support member.

The consistency of the web is about 65% after the action of the TAD dryers operating about a 450 F., before transfer onto the Yankee dryer. An aqueous solution of creping adhesive consisting of polyvinyl alcohol is applied to the Yankee surface by spray applicators at a rate of about 5 lb. per ton of production. The Yankee dryer is operated at a speed of about 600 fpm. The fiber consistency is increased to an estimated 99% before creping the web with a doctor blade. The doctor blade has a bevel angle of about 25 degrees and is positioned with respect to the Yankee dryer to provide an impact angle of about 81 degrees. The Yankee dryer is operated at about 315° F., and Yankee hoods are operated at about 350° F.

The dry, creped web is passed between two calender rolls operated at 540 fpm, so that there is net 6% foreshortening of the web by crepe. The resulting paper has a basis weight of about 22 lb./3000 square feet a caliper of about 0.011", a CD peak elongation of about 9%, and an wet burst strength of about 420 g.

The paper described above is further subjected to the deep embossing process of this invention. Two emboss rolls are engraved with complimentary, nesting protrusions. Said protrusions are frustaconical in shape, with a face diameter of about 0.063" and a floor diameter of about 0.121." The height of the protrusions on each roll is about 0.085."

The engagement of the nested rolls is set to about 0.067," and the paper described above is fed through the engaged gap at a speed of about 120 fpm. The resulting paper has a caliper of about 0.029", a CD peak elongation of about 9%, and a wet bursting strength of about 300 g. The resulting paper has a first surface embossment height of greater than 1000 μm and a second surface embossment height of greater than 1000 μm.

Embodiment 2

In a less preferred example of a through-air dried, differential density structure described in U.S. Pat. No. 4,528,239 may be formed by the following process.

The TAD carrier fabric of Example 1 is replaced with a carrier fabric consisting of 225 bi-axially staggered deflection conduits per inch, and a resin height of about 0.012". The resulting paper prior to embossing has a CD peak elongation of about 12%.

This paper is further subjected to the embossing process of Example 1, and The resulting paper has a caliper of about 0.029", a CD peak elongation of about 11%, and a wet bursting strength of about 300 g. The resulting paper has a first surface embossment height of greater than 650 μm and a second surface embossment height of greater than 650 μm.

Embodiment 3

An alternative embodiment of the present fibrous structure is a paper structure having a wet microcontraction greater than about 5% in combination with any known through air dried process. Wet microcontraction is described in U.S. Pat. No. 4,440,597. An example of embodiment 3 may be produced by the following process.

The wire speed is increased compared to the TAD carrier fabric so that the wet web foreshortening is 10%. The TAD carrier fabric of Example 1 is replaced by a carrier fabric having a 5-shed weave, 36 machine direction filaments and 32 cross-direction filaments per inch. The net crepe forshortening is 20%. The resulting paper prior to embossing has a basis weight of about 22 lb/3000 square feet, CD peak elongation of about 7%, and a wet bursting strength of about 340 g.

This paper is further subjected to the embossing process of Example 1, and The resulting paper has a caliper of about 0.026 inch, a CD peak elongation of about 6%, and a wet bursting strength of about 275 g. The resulting paper has a first surface embossment height of greater than 650 μm and a second surface embossment height of greater than 650 μm.

Embodiment 4

Another embodiment of the fibrous structure of the present invention is the through air dried paper structures having MD impression knuckles as described in U.S. Pat. No. 5,672,248. A commercially available single-ply substrate made according to U.S. Pat. No. 5,672,248 having a basis weight of about 25 lb/3000 square feet, a wet burst strength of about 340 g, a caliper of about 0.032", and a CD peak elongation of about 12%, sold under the Trade-name Scott and manufactured by Kimberly Clark Corporation is subjected to the embossing process of Example 1. The resulting paper has a first surface embossment height value of greater than 650 μm and a second surface embossment height value of greater than 650 μm.

Test Methods

Basis Weight Method

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

Caliper Test

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 14.7 g/cm (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters, or thousandths of an inch (mils).

Density Method

The density, as that term is used herein, of a fibrous structure in accordance with the present invention and/or a sanitary tissue product comprising a fibrous structure in accordance with the present invention, is the average ("apparent") density calculated. The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 $g/in^2$. The density of tissue paper, as that term is used herein, is the average density calculated as the basis weight of that paper divided by the caliper, with the appropriate unit conversions incorporated therein. Caliper, as used herein, of a fibrous structure and/or sanitary tissue product is the thickness of the fibrous structure or sanitary tissue product comprising such fibrous structure when subjected to a compressive load of 14.7 $g/cm^2$.

Wet Burst Strength Method

"Wet Burst Strength" as used herein is a measure of the ability of a fibrous structure and/or a paper product incorporating a fibrous structure to absorb energy, when wet and subjected to deformation normal to the plane of the fibrous structure and/or paper product. Wet burst strength may be measured using a Thwing-Albert Burst Tester Cat. No. 177 equipped with a 2000 g load cell commercially available from Thwing-Albert Instrument Company, Philadelphia, Pa.

For 1-ply products, take two (2) usable fibrous structures, according to the present invention, from the finished product roll and carefully separate them at the perforations. Stack the two separated fibrous structures on top of each other and cut them so that they are approximately 228 mm in the machine direction and approximately 114 mm in the cross machine direction, each one finished product unit thick. First, age the samples by attaching the sample stack together with a small paper clip and "fan" the other end of the sample stack by a clamp in a 107° C. (±3° C.) forced draft oven for 5 minutes (±10 seconds). After the heating period, remove the sample stack from the oven and cool for a minimum of three (3) minutes before testing. Take one sample strip, holding the sample by the narrow cross machine direction edges, dipping the center of the sample into a pan filled with about 25 mm of distilled water. Leave the sample in the water four (4) (+0.5) seconds. Remove and drain for three (3) (±0.5) seconds holding the sample so the water runs off in the cross machine direction. Proceed with the test immediately after the drain step. Place the wet sample on the lower ring of a sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest g.

Total Dry Tensile Strength Test

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

% Elongation(Stretch)

Prior to tensile testing, the paper samples to be tested should be conditioned according to TAPPI Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of the constant temperature and humidity room.

Discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1 inch (2.54 cm) wide strips in the machine direction from stacks 1 and 3. Cut two 1 inch (2.54 cm) wide strips in the cross direction from stacks 2 and 4. There are now four 1 inch (2.54 cm) wide strips for machine direction tensile testing and four 1 inch (2.54 cm) wide strips for cross direction tensile testing. For these finished product samples, all eight 1 inch (2.54 cm) wide strips are five usable units (also termed sheets) thick.

For unconverted stock and/or reel samples, cut a 15 inch (38.1 cm) by 15 inch (38.1 cm) sample which is 8 plies thick from a region of interest of the sample using a paper cutter (JDC-1-10 or JDC-1-12 with safety shield from Thwing-Albert Instrument Co of Philadelphia, Pa.). Ensure one 15 inch (38.1 cm) cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15 inch (38.1 cm) by 15 inch (38.1 cm) sample which is 8 plies thick, cut four strips 1 inch (2.54 cm) by 7 inch (17.78 cm) with the long 7 (17.78 cm) dimension running parallel to the machine direction. Note these samples as machine direction reel or unconverted stock samples. Cut an additional four strips 1 inch (2.54 cm) by 7 inch (17.78 cm) with the long 7 (17.78 cm) dimension running parallel to the cross direction. Note these samples as cross direction reel or unconverted stock samples. Ensure all previous cuts are made using a paper cutter (JDC-1-10 or JDC-1-12 with safety shield from Thwing-Albert Instrument Co. of Philadelphia, Pa.). There are now a total of eight samples: four 1 inch (2.54 cm) by 7 inch (17.78 cm) strips which are 8 plies thick with the 7 inch (17.78 cm) dimension running parallel to the machine direction and four 1 inch (2.54 cm) by 7 inch (17.78 cm) strips which are 8 plies thick with the 7 inch (17.78 cm) dimension running parallel to the cross direction.

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the 1st and 2nd gauge lengths to 2.00 inches (5.08 cm). The break sensitivity should be set to 20.0 grams and the sample width should be set to 1.00 inch (2.54 cm) and the sample thickness at 0.025 inch (0.0635 cm).

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2-3 seconds passes after starting the test before any value is recorded, the tensile strip is too slack.

Start the tensile tester as described in the tensile tester instrument manual. The test is complete after the cross-head automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

If the percentage elongation at peak (% Stretch) is desired, determine that value at the same time tensile strength is being measured. Calibrate the elongation scale and adjust any necessary controls according to the manufacturer's instructions.

For electronic tensile testers with digital panel meters read and record the value displayed in a second digital panel meter at the completion of a tensile strength test. For some electronic tensile testers this value from the second digital panel meter is percentage elongation at peak (% stretch); for others it is actual inches of elongation.

Repeat this procedure for each tensile strip tested.

Calculations: Percentage Elongation at Peak (% Stretch)—For electronic tensile testers displaying percentage elongation in the second digital panel meter:

Percentage Elongation at Peak (% Stretch)=(Sum of elongation readings) divided by the (Number of readings made).

For electronic tensile testers displaying actual units (inches or centimeters) of elongation in the second digital panel meter:

Percentage Elongation at Peak (% Stretch)=(Sum of inches or centimeters of elongation) divided by ((Gauge length in inches or centimeters) times (number of readings made))

Results are in percent. Whole number for results above 5%; report results to the nearest 0.1% below 5%.

Horizontal Full Sheet (HFS)

The Horizontal Full Sheet (HFS) test method determines the amount of distilled water absorbed and retained by the paper of the present invention. This method is performed by first weighing a sample of the paper to be tested (referred to herein as the "Dry Weight of the paper"), then thoroughly wetting the paper, draining the wetted paper in a horizontal position and then reweighing (referred to herein as "Wet Weight of the paper"). The absorptive capacity of the paper is then computed as the amount of water retained in units of grams of water absorbed by the paper. When evaluating different paper samples, the same size of paper is used for all samples tested.

The apparatus for determining the HFS capacity of paper comprises the following: An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the paper tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The paper to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram per paper sample absorptive capacity of the sample is defined as (Wet Weight of the paper-Dry Weight of the paper).

Embossment Height Test Method

Embossment height is measured using a GFM Primos Optical Profiler instrument commercially available from GFMesstechnik GmbH, Warthestraβe 21, D14513 Teltow/Berlin, Germany. The GFM Primos Optical Profiler instrument includes a compact optical measuring sensor based on the digital micro mirror projection, consisting of the following main components: a) DMD projector with 1024×768 direct digital controlled micro mirrors, b) CCD camera with high resolution (1300×1000 pixels), c) projection optics adapted to a measuring area of at least 27×22 mm, and d) recording optics adapted to a measuring area of at least 27×22 mm; a table tripod based on a small hard stone plate; a cold light source; a measuring, control, and evaluation computer; measuring, control, and evaluation software ODSCAD 4.0, English version; and adjusting probes for lateral (x-y) and vertical (z) calibration.

The GFM Primos Optical Profiler system measures the surface height of a sample using the digital micro-mirror pattern projection technique. The result of the analysis is a map of surface height (z) vs. xy displacement. The system has a field of view of 27×22 mm with a resolution of 21 microns. The height resolution should be set to between 0.10 and 1.00 micron. The height range is 64,000 times the resolution.

To measure a fibrous structure sample do the following:

1. Turn on the cold light source. The settings on the cold light source should be 4 and C, which should give a reading of 3000K on the display;
2. Turn on the computer, monitor and printer and open the ODSCAD 4.0 Primos Software.
3. Select "Start Measurement" icon from the Primos taskbar and then click the "Live Pic" button.
4. Place a 30 mm by 30 mm sample of fibrous structure product conditioned at a temperature of 73° F.±2° F. (about 23° C.±1° C.) and a relative humidity of 50%±2% under the projection head and adjust the distance for best focus.
5. Click the "Pattern" button repeatedly to project one of several focusing patterns to aid in achieving the best focus (the software cross hair should align with the projected cross hair when optimal focus is achieved). Position the projection head to be normal to the sample surface.
6. Adjust image brightness by changing the aperture on the lens through the hole in the side of the projector head and/or altering the camera "gain" setting on the screen. Do not set the gain higher than 7 to control the amount of electronic noise. When the illumination is optimum, the red circle at bottom of the screen labeled "I.O." will turn green.
7. Select Technical Surface/Rough measurement type.
8. Click on the "Measure" button. This will freeze on the live image on the screen and, simultaneously, the image will be captured and digitized. It is important to keep the sample still during this time to avoid blurring of the captured image. The image will be captured in approximately 20 seconds.
9. If the image is satisfactory, save the image to a computer file with ".omc" extension. This will also save the camera image file ".kam".
10. To move the date into the analysis portion of the software, click on the clipboard/man icon.
11. Now, click on the icon "Draw Cutting Lines". Make sure active line is set to line 1. Move the cross hairs to the lowest point on the left side of the computer screen image and click the mouse. Then move the cross hairs to the lowest point on the right side of the computer screen image on the current line and click the mouse. Now click on "Align" by marked points icon. Now click the mouse on the lowest point on this line, and then click the mouse on the highest point on this line. Click the "Vertical" distance icon. Record the distance measurement. Now increase the active line to the next line, and repeat the previous steps, do this until all lines have been measured (six (6) lines in total. Take the average of all recorded numbers, and if the units is not micrometers, convert it to micrometers (μm). This number is the embossment height. Repeat this procedure for another image in the fibrous structure product sample and take the average of the embossment heights.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An absorbent tissue-towel paper product comprising one essentially continuous ply of fibrous structure having a first surface and a second surface, wherein the product has an HFS absorbency greater than 8 g/g and the first surface exhibits an embossment height of at least 650 μm and the second surface exhibits an embossment height of at least about 650 μm, wherein the paper product exhibits a finished product caliper that is greater than 150% of its caliper before embossing and wherein the ply of fibrous structure comprises a through-air-dried fibrous ply.

2. An absorbent tissue-towel paper product according to claim 1 wherein the first surface exhibits an embossment height of at least 1000 μm and the second surface exhibits an embossment height of at least 1000 μm.

3. An absorbent tissue-towel paper product according to claim 1 wherein the ply of fibrous structure comprises a differential density fibrous ply.

4. The tissue paper product according to claim 1 wherein the ply of fibrous structure comprises a wet laid fibrous structure ply.

5. An absorbent tissue-towel paper product comprising one essentially continuous ply of fibrous structure having a first surface and a second surface, wherein the product has an HFS absorbency greater than 8 g/g and the first surface exhibits an embossment height of at least 650 μm and the second surface exhibits an embossment height of at least about 650 μm, wherein the paper product exhibits a finished product caliper that is greater than 150% of its caliper before embossing and wherein the ply of fibrous structure comprises a conventionally pressed fibrous structure ply.

* * * * *